US006287426B1

(12) United States Patent
Edwards et al.

(10) Patent No.: US 6,287,426 B1
(45) Date of Patent: Sep. 11, 2001

(54) PAPER MACHINE FOR MANUFACTURING STRUCTURED SOFT PAPER

(75) Inventors: Steven Edwards, Freemont, WI (US); Ingvar Klerelid; Anders Lindén, both of Karlstad (SE)

(73) Assignee: Valmet-Karlstad AB, Karlstad (SE)

( * ) Notice: Subject to any disclaimer, the term of this patent is extended or adjusted under 35 U.S.C. 154(b) by 0 days.

(21) Appl. No.: 09/392,700

(22) Filed: Sep. 9, 1999

Related U.S. Application Data

(60) Provisional application No. 60/113,175, filed on Dec. 21, 1998.

(30) Foreign Application Priority Data

Sep. 9, 1998 (SE) ..... 9803041

(51) Int. Cl.[7] ..... D21F 9/00; D21F 11/00

(52) U.S. Cl. ..... 162/281; 162/280; 162/309; 162/348; 162/358.3; 162/362; 162/363

(58) Field of Search ..... 162/280–281, 162/309, 348, 352, 358.3, 358.4, 362–363, 383

(56) References Cited

U.S. PATENT DOCUMENTS

| | | | |
|---|---|---|---|
| 3,301,746 | 1/1967 | Sanford et al. . | |
| 3,537,954 | 11/1970 | Justus . | |
| 3,994,771 | 11/1976 | Morgan, Jr. et al. . | |
| 4,309,246 | 1/1982 | Hulit et al. . | |
| 4,356,059 * | 10/1982 | Hosteler | 162/111 |
| 4,440,597 | 4/1984 | Wells et al. . | |
| 4,529,480 | 7/1985 | Trokhan . | |
| 4,533,437 * | 8/1985 | Curran et al. | 162/281 |
| 4,834,838 | 5/1989 | Klowak . | |
| 4,849,054 | 7/1989 | Klowak . | |
| 5,364,504 | 11/1994 | Smurkoski et al. . | |
| 5,411,636 | 5/1995 | Hermans et al. . | |
| 5,529,664 | 6/1996 | Trokhan et al. . | |
| 5,569,358 | 10/1996 | Cameron . | |
| 5,591,305 | 1/1997 | Cameron . | |
| 5,667,636 | 9/1997 | Engel et al. . | |
| 5,855,739 | 1/1999 | Ampulski et al. . | |

FOREIGN PATENT DOCUMENTS

| | | |
|---|---|---|
| WO 91/16493 | 10/1991 | (WO) . |
| WO 98/51859 | 11/1998 | (WO) . |

* cited by examiner

*Primary Examiner*—Jose Fortuna
(74) *Attorney, Agent, or Firm*—Alston & Bird LLP

(57) ABSTRACT

A paper machine for manufacturing a structured soft paper web are described, which machine has a wet section, a press section, a drying section and a web-carrying clothing running around a suction device close to a smooth impermeable belt in the press section for the creation of a transfer point. In accordance with the invention, structuring means for structuring the web are arranged between the press section and the drying section. The structuring means comprise either said clothing in the shape of a permeable wire, the structure of which is made up of depressions and arched surface parts, including knuckles in a quantity of 25–150 knuckles per $cm^2$, and a suction device that, at a vacuum of 40–80 kPa, draws the web to the structured side of the wire so that the web acquires the structure of the wire, wherein the wire operates at a speed less than or equal to the speed of the belt, or a creping doctor that is located in a space between the belt and the clothing and in scraping contact with the belt so as to loose the web during simultaneous crinkling, the suction device having a suction gap for initial suction of the web firmly to the clothing for transfer to a drying cylinder. The web-carrying clothing operates then at a speed that is less than the speed of the belt.

13 Claims, 5 Drawing Sheets

PAPER MACHINE FOR MANUFACTURING STRUCTURED SOFT PAPER

CROSS-REFERENCE TO RELATED APPLICATION

This application claims the benefit of U.S. Provisional Patent Application Serial No. 60/113,175 filed Dec. 21, 1998.

FIELD OF THE INVENTION

The present invention relates to a paper machine and method for manufacturing a structured fibrous web of soft paper. The invention relates more particularly to such a paper machine and method in which through-air drying of the web is avoided.

BACKGROUND OF THE INVENTION

Paper machines for manufacturing soft paper with high bulk are known through a number of patent specifications. Usually a texturing wire or a texturing felt is used, which, together with the formed paper web, runs through a press nip in which the paper web is pressed into the texturing wire and thus acquires a textured pattern on one of its sides. Paper machines with such texturing wires and press nips are described in U.S. Pat. No. 3,301,746, U.S. Pat. No. 3,537,954, U.S. Pat. No. 4,309,246, U.S. Pat. No. 4,533,437, U.S. Pat. No. 5,569,358, U.S. Pat. No. 5,591,305 and WO 91/16493 (corresponding to SE-466 063). The disadvantage with paper machines in accordance with these patents is that the dewatering in the press nip is relatively low, so that the dry solids content of the paper web is low when the paper web is transferred to the drying cylinder, which results in the output of the paper machine being relatively low.

U.S. Pat. No. 4,849,054 describes a machine for manufacturing a textured fibrous web with high bulk, where the fibrous web is pressed in a single-clothed roller press having a transfer roll, which, together with a texturing wire, defines a nip at a transfer point for the web. The press dewaters the web to a dry solids content of 30 to 50 percent. At the transfer point, the texturing wire runs around a stationary suction pipe, which has a slot opening facing the nip, the slot opening being sufficiently wide that the fibrous web is not compressed when it runs through the nip. By means of the suction from the suction pipe via the slot opening, the fibrous web is transferred to the texturing wire and formed in accordance with the surface of the texturing wire facing the fibrous web, which surface has a three-dimensional pattern. Before the transfer point, the fibrous web has a speed which is greater than the speed of the texturing wire. The roller that carries the fibrous web up to the non-compressing nip has a smooth surface and it is well known that, in practice, there are problems associated with transferring a fibrous web that has been pre-pressed to a dry solids content of 30–50 percent from a smooth surface to a wire and retaining it on the wire. If the suction, for any reason, were to stop or be reduced, the fibrous web would continue with the smooth roller, which might result in shut-down and damage to the machine. The paper machine in accordance with U.S. Pat. No. 4,849,054 cannot be operated at the high speeds that are demanded today, because of the configuration of the press and the transfer point with a stationary suction pipe, around which the texturing wire runs with high friction between them.

A similar arrangement is shown in U.S. Pat. No. 4,834,838, particularly FIG. 9, where the fibrous web passes a suction opening so that it is drawn to the wire, whereby the surface facing the wire should acquire a wave-shaped pattern corresponding to the wire, while the other surface of the fibrous web should be smooth. The patent is concerned with the manufacture of fibrous tape base material of the type used in making masking tape, rather than soft structured paper. A foremost concern of the patent is imparting stretchability to the tape base material in the machine direction while making the tape surface smooth and attaining a thin caliper. Differences in speed between the wire and the opposite web-carrying element are used to make the web stretchable. The fibrous web has been dewatered before it reaches said suction opening, but no description is given of how this dewatering is effected in this specific embodiment. In any event, it is not apparent from this patent specification that a bulk should be recreated after pressing in a roller nip. The wave shape, limited to one surface, will be partially or completely destroyed during the subsequent contacts with different elements, such as drying cylinders and felts, although the stretchability achieved in the fibrous web is purportedly retained.

U.S. Pat. No. 5,411,636 describes the manufacture of soft paper, where the paper web is formed on a forming wire, pre-pressed in a double-felted press nip and transferred to a coarse-meshed wire. The paper web, while being carried by the coarse-meshed wire, is subjected to an abrupt vacuum pulse in a suction zone so that the paper web is drawn into the openings and depressions of the wire so that the paper web acquires an increased thickness and, thus, increased bulk. The coarse-meshed wire then carries the paper web to the drying cylinder. The double-felted press nip results in the dry solids content of the paper web after the press nip being relatively low, namely 25–30 percent. As no dewatering can be carried out in the nip at the drying cylinder, the dry solids content of the paper web when it is transferred to the drying cylinder is correspondingly low.

To increase the dry solids content of the paper web up to the drying cylinder without subjecting the paper web to extreme compressing forces in one or several press nips, the technique of through-blow drying is often used, as shown, for instance, in U.S. Pat. No. 3,301,746, U.S. Pat. No. 5,411,636, U.S. Pat. No. 5,667,636 (corresponding to WO 95/00706), U.S. Pat. No. 4,440,597, U.S. Pat. No. 5,364,504, U.S. Pat. No. 5,529,664, U.S. Pat. No. 3,994,771 (corresponding to SE-7605986-4), and U.S. Pat. No. 4,529,480. This technique produces a paper web with high bulk. A paper machine with through-blow drying does, however, entail high investment costs as well as high running costs, mainly with respect to energy consumption.

SUMMARY OF THE INVENTION

The present invention seeks to provide an improved paper machine with which it is possible, without through-blow drying, to re-create at least an essential part of the bulk reduction experienced by the paper web when it is initially dewatered in a roll-press or shoe-press nip, and to manufacture a fibrous web with high bulk and a high dry solids content before the drying cylinder so as to achieve high production at a reasonable cost.

The invention also seeks to provide an improved paper machine that produces a paper web that qualitatively equals the results achieved by through-blow drying, but at a lower cost in respect of installation as well as operation and without hot air being required.

The invention further seeks to provide a paper machine that has a press section in which a high level of dewatering of the paper web is carried out and which has webstructuring components arranged before the drying cylinder that re-create an essential part of the bulk lost during pressing.

In accordance with a preferred embodiment of the invention, a paper machine comprises a wet section operable to form a wet fibrous web, a press section arranged to receive the web from the wet section and to dewater the web, an endless clothing that receives the web downstream of the press section, and a drying section having a drying cylinder that forms a transfer nip with a transfer roll about which the clothing with the web carried thereon passes. The press section includes at least one press having two cooperating press members forming a press nip therebetween, the press further including a smooth impermeable belt and a press felt arranged to pass through the press nip with the web enclosed therebetween. The endless clothing runs in a loop and is arranged to receive the web from the impermeable belt downstream of the press section. The clothing is arranged to pass over a transfer device disposed proximate to the impermeable belt and the transfer device is operable to suction the web onto the clothing at a transfer point, the clothing with the web carried thereon then passing around the transfer roll. The web passes through the transfer nip and is transferred onto the drying cylinder in the transfer nip. The paper machine further includes at least one web-structuring component for structuring the web disposed downstream of the press section and upstream of the drying section. The web-structuring component comprises one of (1) the clothing formed as a permeable wire with a web-contacting structured side having depressions defined therein, and a suction device disposed in the loop of the clothing and in slidable contact with a side of the clothing opposite from the structured side thereof, the suction device being operable to draw the fibrous web into intimate contact with the structured side of the clothing so that the fibrous web is deflected into said depressions and assumes the structure of the structured side, and wherein the clothing travels at a speed equal to or less than that of the smooth impermeable belt; and (2) a creping doctor in scraping contact with the smooth impermeable belt at a location proximate to and upstream of the transfer point where the web is transferred onto the clothing, the creping doctor being operable to scrape the web from the impermeable belt and to crepe the web, and wherein the clothing carrying the web to the drying cylinder travels at a speed that is less than that of the smooth impermeable belt.

Preferably, the clothing, onto which the web is transferred from the impermeable belt, travels at a speed less than that of the impermeable belt. Accordingly, a "rush-transfer" onto the clothing is achieved, which imparts micro-crinkling of the web so as to foreshorten the web in the machine direction and further structure the web to increase bulk.

When the web-structuring component comprises the clothing formed as a permeable wire and the suction device, the structured side of the clothing preferably includes arched surface parts situated between the depressions, the arched surface parts defining knuckles distributed over the structured side such that there are about 25 to 150 knuckles per $cm^2$, and more preferably about 50 to 100 knuckles per $cm^2$. The suction device preferably is operable to exert a vacuum of about 40 to 80 kPa.

When the web-structuring component comprises the creping doctor, the impermeable belt is arranged to carry the web past the transfer device such that the web at one point passes closely adjacent to the transfer device, and the creping doctor is disposed downstream of the point where the web passes closely adjacent the transfer device.

In a preferred embodiment of the invention, the impermeable belt is arranged to form a non-compressing nip with the transfer device, or alternatively, the impermeable belt is arranged such that the web and the transfer device form a gap therebetween where the belt passes closest to the transfer device. The gap preferably has a width greater than the thickness of the web.

Preferably, the creping doctor has a doctor blade that forms an acute angle with the smooth impermeable belt of about 5° to 25°. The press section preferably is operable to dewater the fibrous web to achieve a dry solids content of about 35 to 48 percent.

The invention is described further in the following with reference to the drawings.

DETAILED DESCRIPTION OF THE INVENTION

Figure 1:
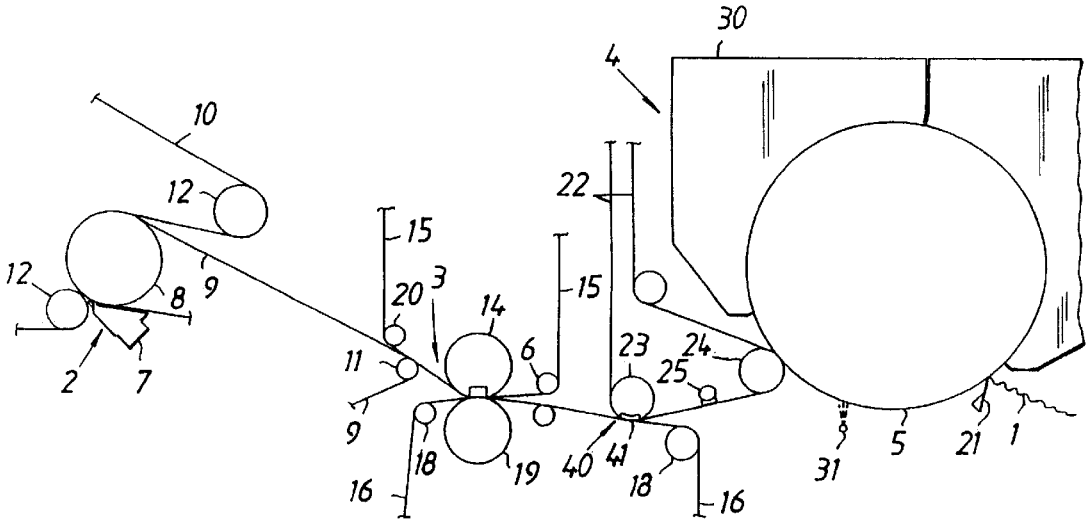
FIG. 1 shows a paper machine in accordance with a first embodiment of the invention.

The present invention now will be described more fully hereinafter with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. Like numbers refer to like elements throughout.

In FIGS. 1–5, 7 and 9, parts of paper machines for manufacturing a structured fibrous web 1 of soft paper, such as tissue and other paper products with low density, are shown schematically. Each of the paper machines comprises a wet section 2, a press section 3 and a drying section 4. The wet section 2 comprises a headbox 7, a forming roll 8, an endless carrying inner clothing 9 and an endless covering outer clothing 10 consisting of a forming wire. The inner and outer clothings 9 and 10 run in separate loops around several guide rolls 11 and 12 respectively. The drying section 4 comprises a drying cylinder 5, which is covered by a hood 30. Preferably, the drying cylinder and hood collectively comprise a Yankee dryer. At the outlet side of the drying section a creping doctor 21 is arranged to crepe the fibrous web 1 off the drying cylinder 5. An application device 31 is provided for applying a suitable glue on the envelope surface of the drying cylinder 5 just before a transfer nip. The press section 3 comprises a press, which has two cooperating first and second press members 14 and 19, which press members 14 and 19 together define a press nip. Further, the press section comprises an endless press felt 15, which runs in a loop around the first press member 14 and guide rolls 6, and an endless impermeable belt 16, which has a smooth surface facing the fibrous web. The smooth impermeable belt 16 runs in a loop around the second press member 19 and a plurality of guide rolls 18.

Figure 2:
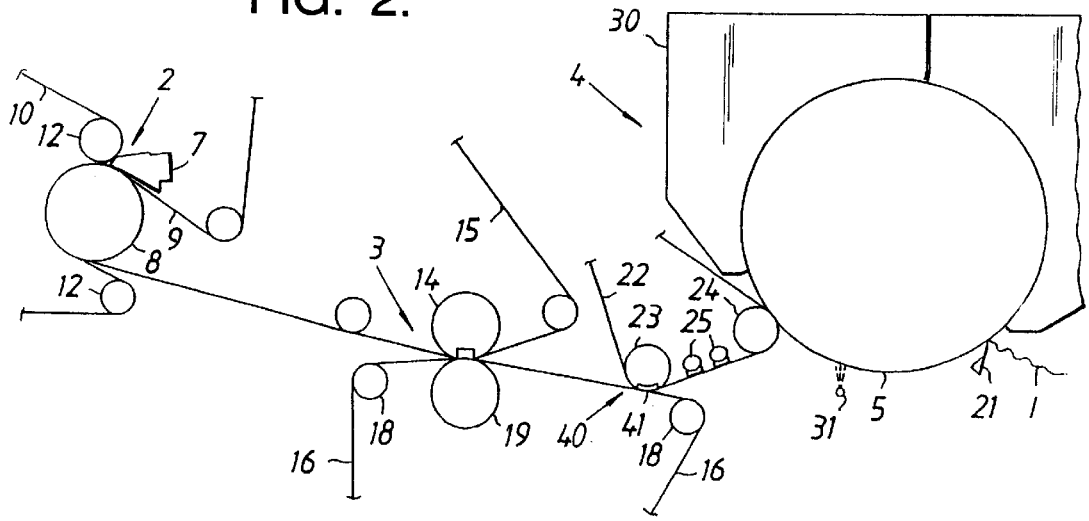
FIG. 2 shows a paper machine in accordance with a second embodiment of the invention.
Figure 3:
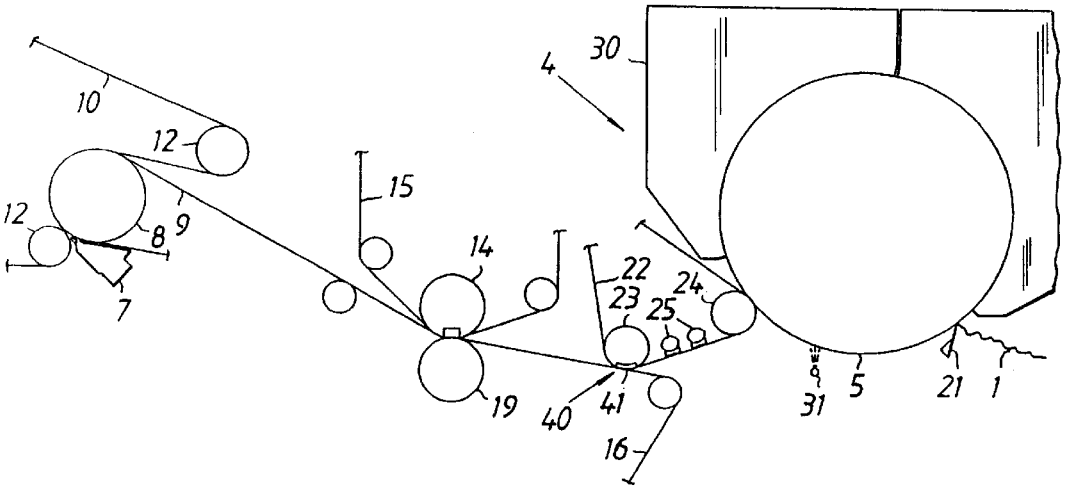
FIG. 3 shows a paper machine in accordance with a third embodiment of the invention.

In the embodiments shown in FIGS. 1–3, the press is a shoe press, the first and second press members of which consist of a shoe press roll 14 and a counter roll 19. The shoe press roll 14 and the counter roll 19 define between them an extended press nip.

In the embodiments shown in FIGS. 4, 5, 7 and 9, the press is a roll press, the first and second press members of which consist of a suction roll 14 and a smooth roll 19. In the embodiment shown in FIG. 9, the press section has two presses, namely the aforementioned roll press, followed by a shoe press, comprising a shoe press roll 32 and a counter roll 33, which together define an extended press nip. The clothings of the shoe press may preferably be the same as the clothings 15 and 16 of the roll press, that is to say that the press felt 15 and the impermeable belt 16 run through the extended press nip in the shoe press. The shoe press roll 32 is arranged in the loop of the press felt 15, which loop comprises a side loop part 34, which runs to an extended suction zone around the suction roll 14 and around guide rolls 37 and then to the extended press nip. Thus rewetting of the fibrous web is prevented and water is removed from the press felt 15. The counter roll 33 is arranged in the loop of the impermeable belt 16. In the embodiment shown in FIG. 9 the same counter roll is used for the two press nips.

Figure 4:
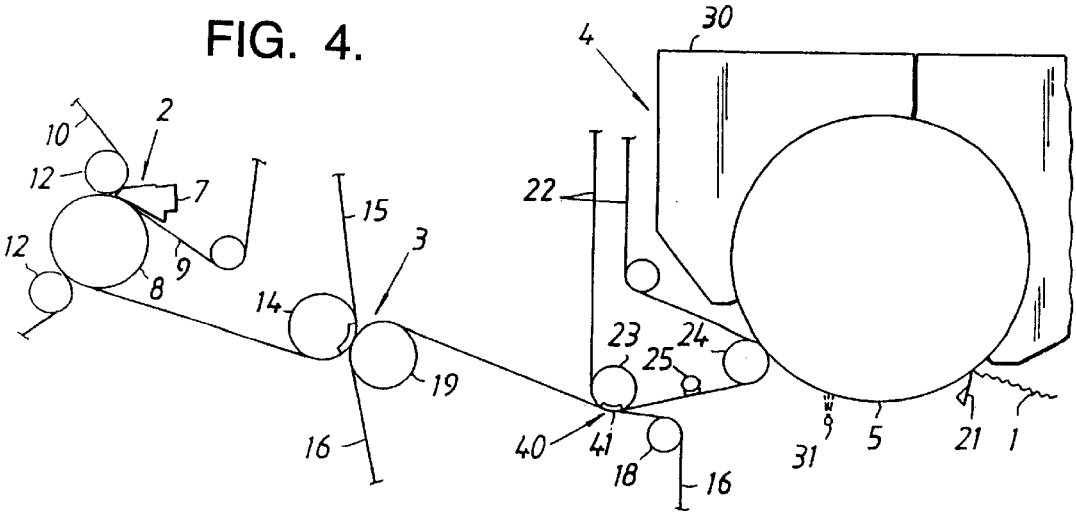
FIG. 4 shows a paper machine in accordance with a fourth embodiment of the invention.

In the embodiments shown in FIGS. 2 and 4, the inner clothing 9 of the wet section 2 is a felt, which is conveyed to the press section 3 to be utilized as a press felt 15 as well and which thus runs in a loop back to the forming roll 8.

In the embodiment shown in FIG. 3, the inner clothing 9 of the wet section 2 is a smooth impermeable belt, which is conveyed to the press section 3 to be utilized as its belt 16 as well and which thus runs in a loop back to the forming roll 8.

Figure 5:
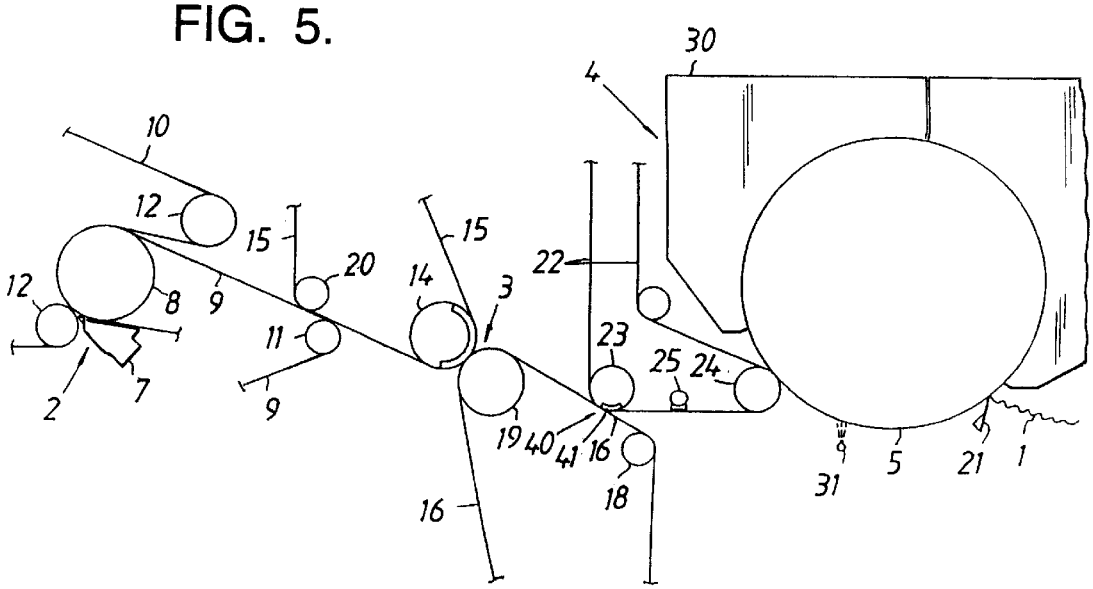
FIG. 5 shows a paper machine in accordance with a fifth embodiment of the invention.
Figure 7:
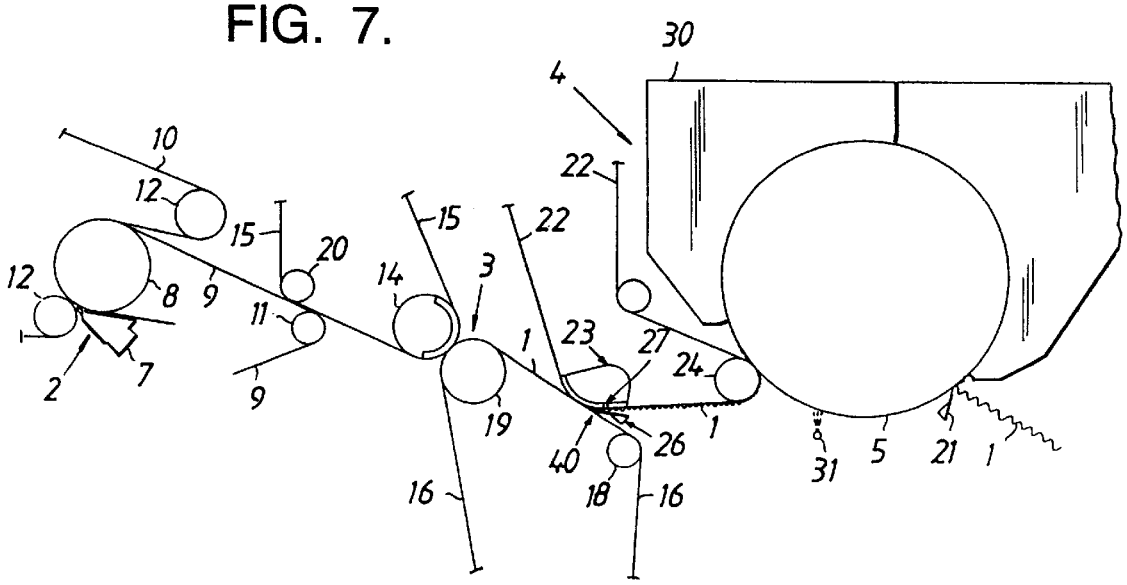
FIG. 7 shows a paper machine in accordance with a sixth embodiment of the invention.

In the embodiments shown in FIGS. 1, 5, and 7, the inner clothing 9 of the wet section 2 is a wire, the press felt 15 running around a pick-up roll 20 arranged close to the loop of the wire 9 so that the press felt 15 and the wire 9 run in contact with each other for transfer of the fibrous web from the wire 9 to the press felt 15. The pick-up roll 20 may be provided with a suction shoe (not shown). Alternatively, the pick-up roll and suction shoe may be replaced by a pick-up suction box. The embodiment shown in FIG. 9 may have a wet section similar to the one shown in FIG. 7.

Figure 8:
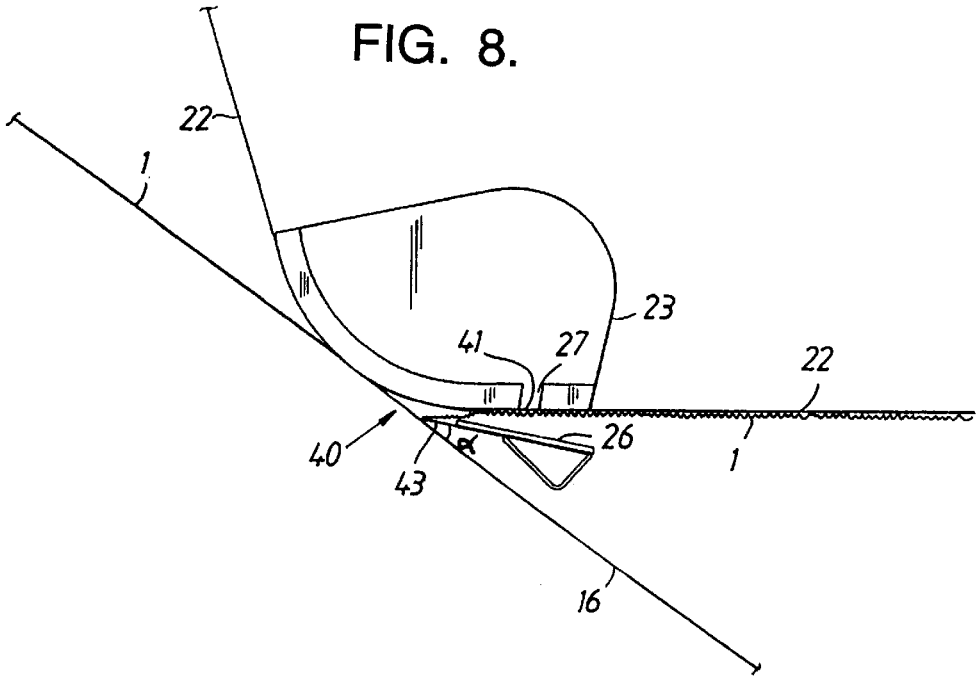
FIG. 8 shows an enlarged view of a creping doctor and a suction shoe, which are included in the paper machine in accordance with FIG. 7.
Figure 9:
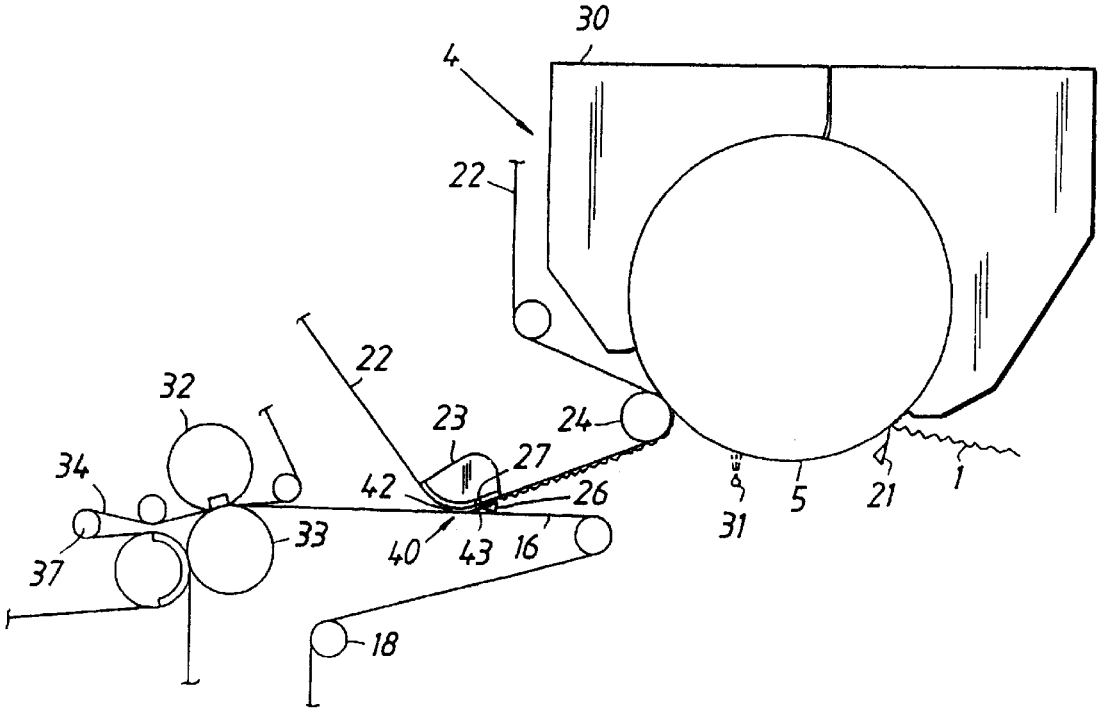
FIG. 9 shows a paper machine in accordance with a seventh embodiment of the invention.

An endless clothing 22 is arranged to run in a loop around a suction device 23, located adjacent to the smooth belt 16 to define a transfer point 40 for transfer of the fibrous web from the smooth belt 16 to the clothing 22. The suction device 23 forms a suction zone 41, designed to enable the suction attachment of the fibrous web and its continued adherence to the clothing 22 as desired. Further, the clothing 22 runs around a transfer roll 24, which defines a non-compressing nip with the drying cylinder 5 for transfer of the paper web from the clothing 22 to the drying cylinder 5. In the embodiments shown in FIGS. 1–5, said suction device 23 is a suction roll, with which the smooth belt 16 defines a non-compressing nip, wherein the suction zone 41 encompasses a sector angle sufficient to secure the transfer of the fibrous web from the smooth belt 16 to the clothing 22. In the embodiment shown in FIGS. 7–9, the suction device is a suction shoe. In FIGS. 7 and 8, the suction shoe 23 and the smooth belt 16 are arranged so close to each other that a non-compressing nip is defined between the clothing 22 and the belt 16. In FIG. 9, the suction shoe 23 and the smooth belt 16 are arranged at a distance from each other so that during operation a gap 42 exists between the clothing 22 and the belt 16, which is greater than the thickness of the web. In the embodiments shown in FIGS. 7–9, the suction zone 41 of the suction shoe 23 is located downstream of said non-compressing nip or, as the case may be, gap 42.

The shown paper machines also comprise special structuring means for structuring the paper web, before it reaches the drying roll 6, in order to achieve increased bulk.

Figure 6:
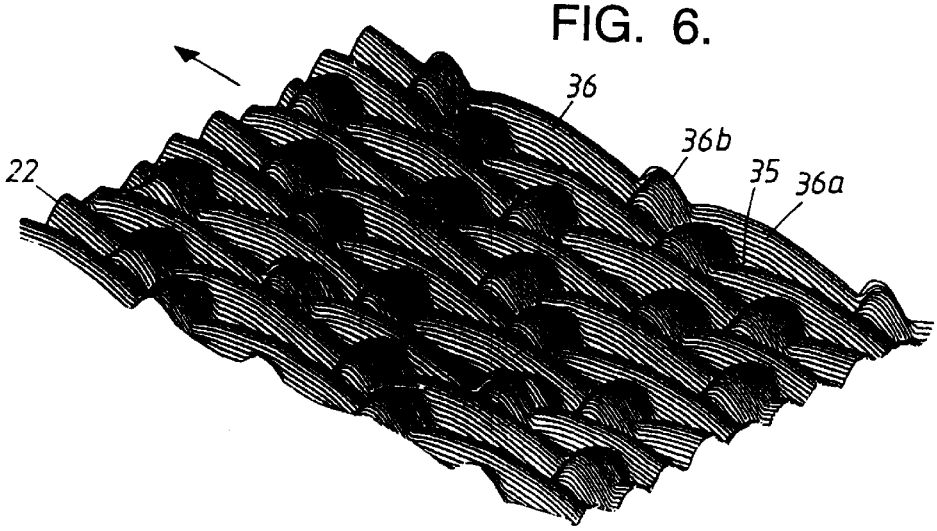
FIG. 6 shows, in perspective, a surface part of a wire included in the paper machines in accordance with FIGS. 1–5.

In the embodiments shown in FIGS. 1–5, said structuring means comprise said clothing 22, that is in the shape of a wire, and a powerful suction device 25. FIG. 6 shows an enlargement of a cut-out surface section of the wire 22, where the machine direction is indicated by an arrow. The wire 22 has a web-contacting side with a structure that is made up of depressions 35 and arched or convex surface parts 36 situated therebetween. The depressions 35 are through-going such that air can be sucked through the wire 22 to the desired extent. The depressions 35 and the arched surface parts 36 are in turn made up of the strands of the wire 22 running longitudinally and transversely as seen in the machine direction, the longitudinal strands exhibiting oblong arc-shaped ridges **36*a* and the transverse strands exhibiting knuckles 36*b*, which knuckles produce bowl-shaped pits in the fibrous web during the structuring process. In the embodiment shown in FIG. 6, the wire has 100 knuckles 36*b* per $cm^2$. Generally, it may exhibit 25–150 knuckles per $cm^2$, preferably 50–100 knuckles per $cm^2$. The powerful suction device mentioned is placed in the loop of the wire 22 upstream of the transfer roll 24 in sliding contact with the wire. The powerful suction device, which may consist of one or several suction boxes, operates at a high vacuum, which acts on the inside of the permeable wire. A suitable vacuum is within the range 40–80 kPa. When the fibrous web passes the powerful suction device together with the wire, the fibrous web is deflecting into the depressions of the wire 22, whereby the fibrous web will assume the structure of the wire as an impression. As the fibrous web is subjected to a high vacuum and the fibrous web is still damp during this suction phase, the structure of the fibrous web will remain after the suction device. To achieve the desired structuring it is also important that the speed of the wire 22 is equal to and preferably less than the speed of the smooth impermeable belt 16**. Most preferred, this difference in speed is 10–25 percent.

In the embodiments shown in FIGS. 7–9, said structuring means comprise a creping doctor 26, the doctor blade 43 of which is aimed against the movement direction of the smooth impermeable belt 16 and forms an acute angle a with the belt 16. This angle $\alpha$ can be in the range 5°–25°, preferably 10°–15°. The creping doctor 26 operates continuously with its doctor blade 43 against the smooth surface of the belt 16 so that the fibrous web is loosed from the belt 16 through scraping and crinkled in the same way as during creping of the fibrous web from the drying cylinder 5. The fibrous web, crinkled through scraping, is conveyed away from the belt up towards a downstream section of the suction shoe 23 having a suction slit 27, which the fibrous web passes during suction attachment to the clothing 22, which may be a wire or a felt. The creping doctor 26 is arranged at a short distance from and downstream of the non-compressing nip (FIGS. 7, 8) or, as the case may be, gap 42 (FIG. 9) that is defined by the suction shoe 23 and the smooth belt, so that a small space is created between the suction shoe 23 and the creping doctor 26, as measured at the edge of the doctor blade 43. To achieve the desired structuring, that is creping, the speed of the wire or felt 22 is less than the speed of the smooth impermeable belt 16. Most preferred, the difference in speed is 10–25 percent. By the use of the creping doctor 26, the fibrous web obtains a crinkled structure that results in increased stretchability and bulk. The nip between the transfer roll 24 and the drying cylinder 5 is non-compressing and the improved properties are not negatively affected by the transfer of the fibrous web to the drying cylinder 5.

As mentioned above, the transfer point at the suction device 23 as shown in FIGS. 1–8 has a non-compressing nip between the clothing 22 and the smooth belt 16. A non-compressing nip is desired particularly for bulk-sensitive grades, for instance tissue. The expression "non-compressing nip" means that the nip should compress the web to such a small extent that after the nip the web substantially regains the bulk it had before the nip. To ensure that as high bulk as possible is maintained, the distance between the suction device 23 and the belt 16 may be pre-set, while the paper machine is not running, so that a small gap is created between the clothing 22 and the belt 16. When a suction roll 23 as shown in FIGS. 1–5 is used, or a suction shoe with a suction zone in the same position, the suction from the suction roll 23 or, alternatively, the suction shoe will during operation lift the belt 16 with the web lying thereon into contact with the wire to define said non-compressing nip. This facilitates a so-called "rush transfer" or "microcontraction", that is to say that the wire 22 runs at a lower speed than the belt 16 so that the web is contracted lengthways causing fine crinkling, so-called micro-creping, as the web runs through the non-compressing nip. The contraction results in increased web thickness. The web will be subjected to a micro-creping when it passes the noncompressing nip at the transfer point as shown in FIGS. 1–5 even if said pre-setting is not carried out, provided that the wire runs at a lower speed than the belt 16. It will be apparent that a greater difference in speed between the wire and the belt will result in augmented fine crinkling. Micro-creping is also obtained in the embodiment shown in FIGS. 7 and 8 when the web passes the non-compressing nip, which lacks a suction zone, since the clothing 22 operates at a lower speed than the belt 16 to achieve creping when the web is loosed from the belt by the creping doctor.

In the embodiments shown in FIGS. 1–3, the counter roll 19 is a smooth roll and is arranged in the loop of the smooth impermeable belt 16. In alternative embodiments (not shown) of the press section shown in FIGS. 1–3, the positions of the rolls 14, 19 are reversed, that is to say that the shoe press roll 14 is arranged in the loop of the smooth impermeable belt 16 and the counter roll 19 in the loop of the press felt 15. In such a configuration, the counter roll 19 may be a suction roll, a grooved roll or a blind-drilled roll.

The paper web is carried to the single-felted press section either by the press felt 15 (FIGS. 1, 2, 4, 5, 7, 9) directly from the forming roll (FIGS. 2 and 4) or from the inner forming wire 9 (FIGS. 1, 5, 7 and 9) or by the smooth belt 16 (FIG. 3) to be conveyed through the press nip whilst enclosed between the press felt 15 and the smooth belt 16. By use of the shown presses, the paper web obtains a dry solids content of at least 35 percent and preferably in the range 38–45 percent. After the single press nip or the second press nip (FIG. 9), the press felt 15 is conveyed away from the smooth belt 16, which in all the embodiments carries the paper web up to the clothing 22.

Many modifications and other embodiments of the invention will come to mind to one skilled in the art to which this invention pertains having the benefit of the teachings presented in the foregoing descriptions and the associated drawings. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

What which is claimed is:

1. A paper machine for manufacturing a structured fibrous web of soft paper, comprising:

a wet section operable to form a wet fibrous web;

a press section arranged to receive the web from the wet section and including at least one press having two cooperating press members forming a press nip therebetween, the press further including a smooth impermeable belt and a press felt arranged to pass through the press nip with the web enclosed therebetween;

a clothing running in a loop and arranged to receive the web from the impermeable belt downstream of the press section, the clothing being arranged to pass over a transfer device disposed proximate to the impermeable belt and the transfer device being operable to suction the web onto the clothing at a transfer point, the clothing with the web carried thereon passing around a transfer roll;

a drying section including a drying cylinder forming a transfer nip with the transfer roll such that the web passes through the transfer nip and is transferred onto the drying cylinder thereat; and at least one web-structuring component for structuring the web disposed downstream of the press section and upstream of the drying section, the web-structuring component comprising one of:

(1) the clothing formed as a permeable wire with a web-contacting structured side having depressions defined therein, and a suction device disposed in the loop of the clothing and in slidable contact with a side of the clothing opposite from the structured side thereof, the suction device being operable to draw the fibrous web into intimate contact with the structured side of the clothing so that the fibrous web is deflected into said depressions and assumes the structure of the structured side, and wherein the clothing travels at a speed equal to or less than that of the smooth impermeable belt; and (2) a creping doctor in scraping contact with the smooth impermeable belt at a location proximate to and upstream of the transfer point where the web is transferred onto the clothing, the creping doctor being operable to scrape the web from the impermeable belt and to crepe the web, and wherein the clothing carrying the web to the drying cylinder travels at a speed that is less than that of the smooth impermeable belt.

2. The paper machine of claim 1, wherein the web-structuring component comprises the clothing formed as a permeable wire and the suction device, and wherein the clothing travels at a speed less than that of the impermeable belt.

3. The paper machine of claim 1, wherein the web-structuring component comprises the clothing formed as a permeable wire and the suction device, and wherein the structured side of the clothing includes arched surface parts situated between the depressions, the arched surface parts defining knuckles distributed over the structured side such that there are about 25 to 150 knuckles per $cm^2$.

4. The paper machine of claim 3, wherein the structured side of the clothing has about 50 to 100 knuckles per $cm^2$.

5. The paper machine of claim 3, wherein the suction device is operable to exert a vacuum of about 40 to 80 kPa.

6. The paper machine of claim 1, wherein the web-structuring component comprises the creping doctor, the impermeable belt being arranged to carry the web past the transfer device such that the web at one point passes closely adjacent to the transfer device, and the creping doctor being disposed downstream of said one point where the web is closely adjacent the transfer device.

7. The paper machine of claim 6, wherein the impermeable belt is arranged to form a non-compressing nip with the transfer device at said one point.

8. The paper machine of claim 6, wherein the impermeable belt is arranged such that the web and the transfer device form a gap therebetween at said one point.

9. The paper machine of claim 8, wherein the gap has a width greater than the thickness of the web.

10. The paper machine of claim 6, wherein the creping doctor has a doctor blade that forms an acute angle with the smooth impermeable belt of about 5° to 25°.

11. The paper machine of claim 1, wherein the press section is operable to dewater the fibrous web to achieve a dry solids content of about 35 to 48 percent.

12. The paper machine of claim 1, wherein the press section comprises two presses.

13. The paper machine of claim 12, wherein the two presses share a common press member that forms two nips with a pair of cooperative press members, the press felt and the impermeable belt being arranged to pass through the two nips with the web enclosed therebetween.

* * * * *